US006955032B2

(12) United States Patent
Smith

(10) Patent No.: US 6,955,032 B2
(45) Date of Patent: Oct. 18, 2005

(54) SHUTTLE PACKER PACKAGING MACHINE

(76) Inventor: Brenton L Smith, 2504 Aga Dr. Suite B, Alexandria, MN (US) 56308

( * ) Notice: Subject to any disclaimer, the term of this patent is extended or adjusted under 35 U.S.C. 154(b) by 0 days.

(21) Appl. No.: 10/435,871

(22) Filed: May 12, 2003

(65) Prior Publication Data

US 2004/0226270 A1 Nov. 18, 2004

(51) Int. Cl.[7] ..... B65B 43/30

(52) U.S. Cl. ..... 53/566; 53/574; 53/382.2; 493/125; 493/127

(58) Field of Search ... 53/566, 574, 579; 493/122–127

(56) References Cited

U.S. PATENT DOCUMENTS 4,348,853 A * 9/1982 Morse et al. ..... 53/566
4,578,054 A * 3/1986 Herrin ..... 493/126
4,596,543 A * 6/1986 Reiser et al. ..... 493/91
5,042,231 A * 8/1991 Konrad et al. ..... 53/458
5,060,451 A * 10/1991 DeMay et al. ..... 53/201
5,115,625 A * 5/1992 Barbulesco et al. ..... 53/467
5,393,291 A * 2/1995 Wingerter ..... 493/116
5,445,590 A * 8/1995 Pazdernik ..... 493/317
5,531,661 A * 7/1996 Moncrief ..... 493/313
5,595,043 A * 1/1997 Radigan ..... 53/201
6,240,707 B1 * 6/2001 Ford et al. ..... 53/381.1
6,571,539 B2 * 6/2003 Gendre et al. ..... 53/456
2003/0230057 A1 * 12/2003 Freemantle

* cited by examiner

*Primary Examiner*—Louis K. Huynh
*Assistant Examiner*—Gloria R. Weeks
(74) *Attorney, Agent, or Firm*—Herman H Bains

(57) ABSTRACT

A shuttle packaging machine includes a support structure having a servomotor driven shuttle device mounted thereon. A transfer arm having suction cups clamps, removes and holds a shipping blank on the shuttle device during all of the packaging functions. The major and minor flaps of the shipping container are held open during the loading of the container. Tucking or folding plows and pneumatic cylinders fold and hold the major and minor flaps. The "shuttle action" of the shuttle device during loading and flap folding allows for a compact arrangement as well as minimizing the number of parts required.

14 Claims, 6 Drawing Sheets

6b
11
11

SHUTTLE PACKER PACKAGING MACHINE

FIELD OF INVENTION

This invention relates to a packaging machine and more particularly to a shuttle packaging machine for forming, product loading, and sealing a paperboard shipping container.

BACKGROUND OF THE INVENTION

Packaging machines for forming, loading and sealing shipping containers are well-known in the packaging machine field. These commercial and prior machines typically include a series of distinct stations for each of the forming, loading and sealing operations. The shipping containers which are to be loaded and sealed are usually moved or carried by a flighted chain and operational stations are usually spaced from each other. Continued usage of chain conveyors results in stretching over time. The various operations of packaging machines is performed pursuant to timed steps and stretching of the chain conveyors can result in these sequential steps being mistimed. The present machine does not use flighted chains but uses servomotors to accomplish the required motions and is of simpler and less expensive construction and avoids timing malfunctions attendant with the prior art machines.

SUMMARY OF THE INVENTION

An object of this invention is to provide a novel and improved packaging machine which uses a shuttle device for controlling and moving the shipping carton during the forming, loading and sealing operations. The operation of the shuttle packaging machine is stepped and is controlled by servomotors to accomplish the forming, loading and sealing functions.

The shuttle device is provided with a transfer arm having suction cups thereon which clamps to a shipping container blank and holds the shipping container on the shuttle device throughout the forming, loading and sealing operations. The servomotor for the shuttle device enables the shuttle device to shuttle (change direction) allowing tucking or folding of the minor flaps and effective loading of product into a shipping container. Since this packaging machine holds a shipping container on the shuttle device throughout all of the packaging functions and allows the shuttle device to shuttle, there is a substantial savings in space and parts.

DESCRIPTION OF THE PREFERRED EMBODIMENT

Figures 1, 2, 3, 4:
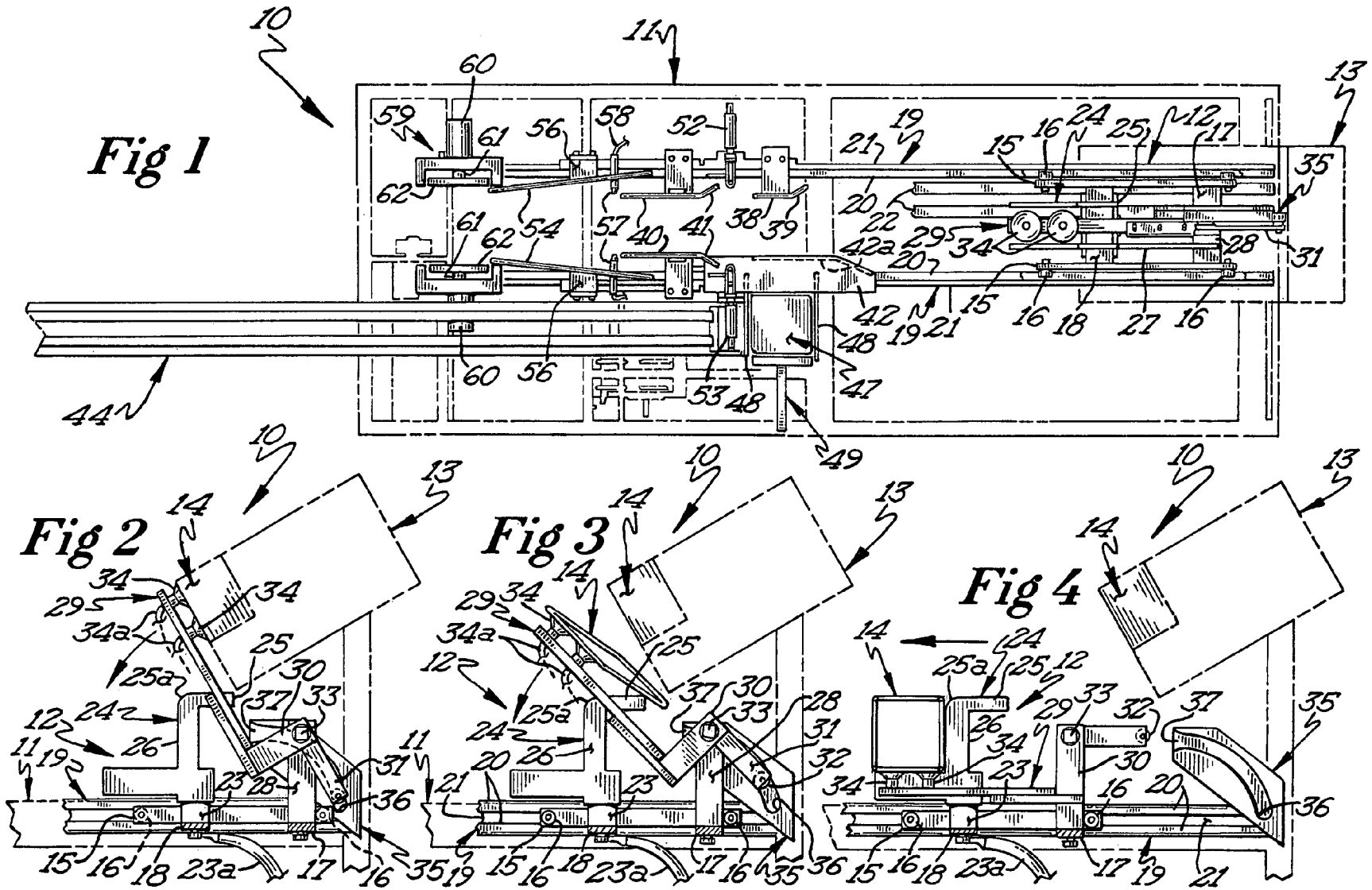
FIG. 1 is a top plan view of the shuttle packaging machine.
FIG. 2–4 are diagrammatic side elevational views of the shuttle device illustrating the sequential steps of removing a shipping container from a magazine and forming the container for acceptance of product at the loading station during movement of the shuttle device.

Referring now to the drawings and more particularly to FIG. 1, it will be seen that one embodiment of the novel shuttle packer packaging machine, designated generally by reference numeral 10, is there shown. The packaging machine 10 includes an elongate support frame 11 which support the various components for accomplishing the various operations of forming, loading and sealing a shipping container. The packaging machine includes a shuttle device 12 which is moveable longitudinally of the frame along tracks during the forming, loading and sealing of shipping containers.

Figure 5:
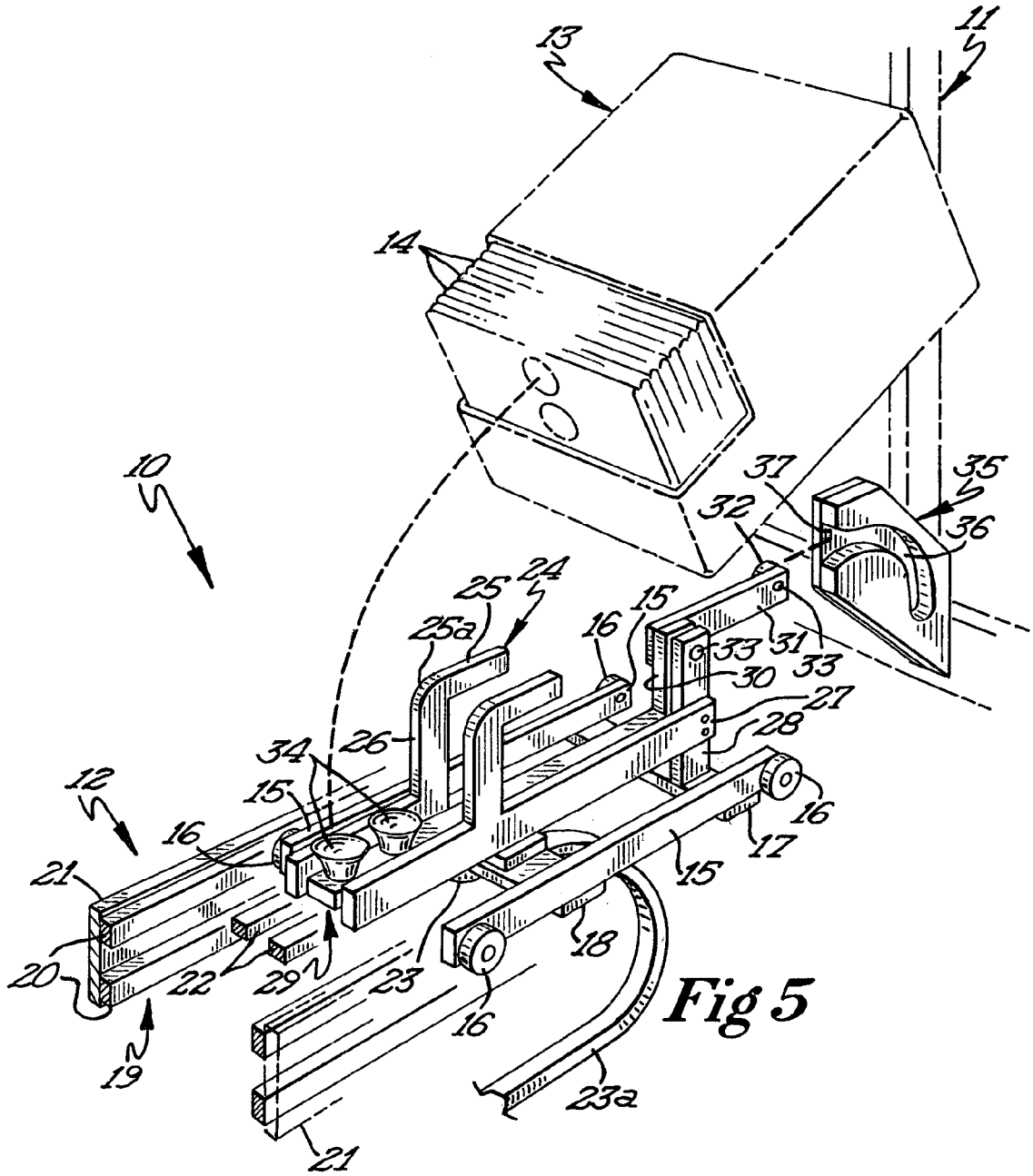
FIG. 5 is a diagrammatic exploded perspective view of the shuttle device illustrating the detailed arrangement of certain parts thereof.

Referring now to FIG. 5, it will be seen that the shuttle device 12 is initially positioned adjacent a magazine 13 containing shipping container blanks 14 which are successively removed from the magazine by the shuttle device. It will be noted that the magazine 13 is mounted on the frame 11 adjacent one end of the frame and is disposed in inclined relation. The magazine 13 is of conventional construction and contains paperboard shipping container blanks which are folded and scored. The shipping container blanks may be formed of material other than paperboard including corrugated paperboard, plastic and similar materials. Referring now to FIG. 2–5, it will be seen that sequential steps in removing shipping container blanks from the magazine and opening and squaring the blanks into open box configuration is there shown.

The shuttle device 12 includes a pair of elongate, substantially straight, laterally spaced apart bars 15 each being provided with a pair of rollers 16. The bars 15 are rigidly interconnected by a transverse plate 17 located adjacent one end of the shuttle device and transverse plate 18 located intermediate the ends of the shuttle device. The rollers 16 are moveable in elongate rail structures 19 which re mounted on and extend longitudinally of the support frame. The rail structures are laterally spaced apart and each includes vertically spaced elongate track members 20 which are rigidly secured to a vertical plate 21.

Means are provided for moving the shuttle device 12 back and forth along the rail structures during the packaging functions. This means includes a traction rail 22 comprised of a pair of laterally spaced apart elongate rails 22*a*. A reversible servomotor 23 having a pair of rail engaging rollers (not shown) engaging the traction rail drives the shuttle device in forward and reverse directions. A power cable 23*a* connects the servomotor to a control computer (not shown) and to source of electrical power. The servomotor is operated by a computer program which controls the complex movements of the shuttle device in response to feedback signals in a well-known manner.

The shuttle device 12 is provided with a pair of laterally spaced, substantially parallel box former members 24 each including an upper horizontal arm 25, a vertical arm 26 and a lower horizontal arm 27. A plate 27*a* is secured to the lower surface of the lower horizontal arms 27 and to the plate 18. The plate 27*a* rigidly secures the former members 24 together. A vertical post 28 is secured to the plate 17 and extends upwardly there from. It will be noted that lower horizontal arm 27 of one of the box former members 24 extends beyond the vertical arm and is rigidly attached to the vertical post 28. The other lower horizontal arm 27 terminates at the associated vertical arm 26. It will be noted that the outer surface of each upper horizontal arm 25 transitions smoothly to the associated vertical arm 26 to form an arcuate surface 25*a*.

The shuttle device 12 also includes an elongate normally horizontal set up or transfer arm 29. The transfer arm 29 is provided with a vertical arm element 30 rigidly secured to one end thereof and projecting upwardly there from. A horizontal arm element 31 is secured to the upper end of the vertical arm element 30 and projects there from. The outer end of the horizontal arm element 31 has a cam roller or follower 32 mounted thereon. The vertical arm element 30 is pivotally connected to the post 28 by a pivot 33 to permit vertical swinging of the transfer arm about a horizontal axis. The transfer arm 29 is provided with suction cups 34 at one end thereof for engaging a shipping carton blank 14 in the magazine 13 and removing the blank 14 there from. The suction cups 34 are connected to a vacuum generator (not shown) of conventional construction by a conduit 34*a*. A vacuum valve (not shown) is interconnected to the conduit 34*a* and permits a vacuum to be selectively produced at the suction cup 34 to allow clamping of the cups to blanks 14. The vacuum cups 34 hold the shipping carton on the shuttle device throughout the performance of the packaging functions which are described herein below.

Means are provided for pivoting the transfer arm during removal of a shipping container blank 14 from the magazine. This means includes a cam member 35 mounted on the support frame 11 adjacent the magazine 13. The cam member 35 has a slot-defining generally arcuate cam track 36 therein having an open end 37. The cam follower is moveable in the track 36 to cause the transfer arm to pivot upwardly until the suction cups 34 engage and clamp to a shipping container blank 14. It will be noted that the transfer arm is pivoted upwardly when the shuttle device is moving in a return or downstream direction. The cam follower will enter the cam slot through the open end 37 and the transfer arm will be pivoted upwardly for engaging and clamping to a shipping container blank 14.

Referring again to FIG. 2–4, it will be seen that as the transfer arm is pivoted from the position illustrated in FIG. 2 to the horizontal position illustrated in FIG. 4, the shipping container blank 14 will engage the box former member 24 to square the container blank 14 to the open box configuration. During the pivoting of the transfer arm to the horizontal position, the shuttle device 12 will be moving in a downstream direction and the cam follower will disengage from cam member 35 as best seen in FIG. 4. The movement of the shuttle device 12 during this blank removal and forming sequence is controlled by the servomotor 23. The timing of these sequential steps is controlled by the computer program. The vacuum to the vacuum cups 34 will remain on through the loading step and will be released as the shuttle device returns to the magazine 13.

After the shipping container 14 is opened to its configuration in FIG. 4, the shuttle device will continue movement in a downstream direction. The end flaps of the shipping container will be in an open and unfolded condition as the shuttle device 12 is moved towards the loading station. It should be noted that the shipping container 14, in the embodiment shown, when loaded and sealed will be of conventional six-sided configuration having opposed ends defined by horizontal major and vertical minor flaps. The vertical minor flaps 14*a* and the horizontal major flaps 14*b* at the loading end of the shipping container 14 will, of course, remain open to permit loading of the product into the container. The vertical minor flaps 14*c* at the non-loading end will be closed while the horizontal major flaps 14*d* will remain open until the loading is complete.

Figure 6:
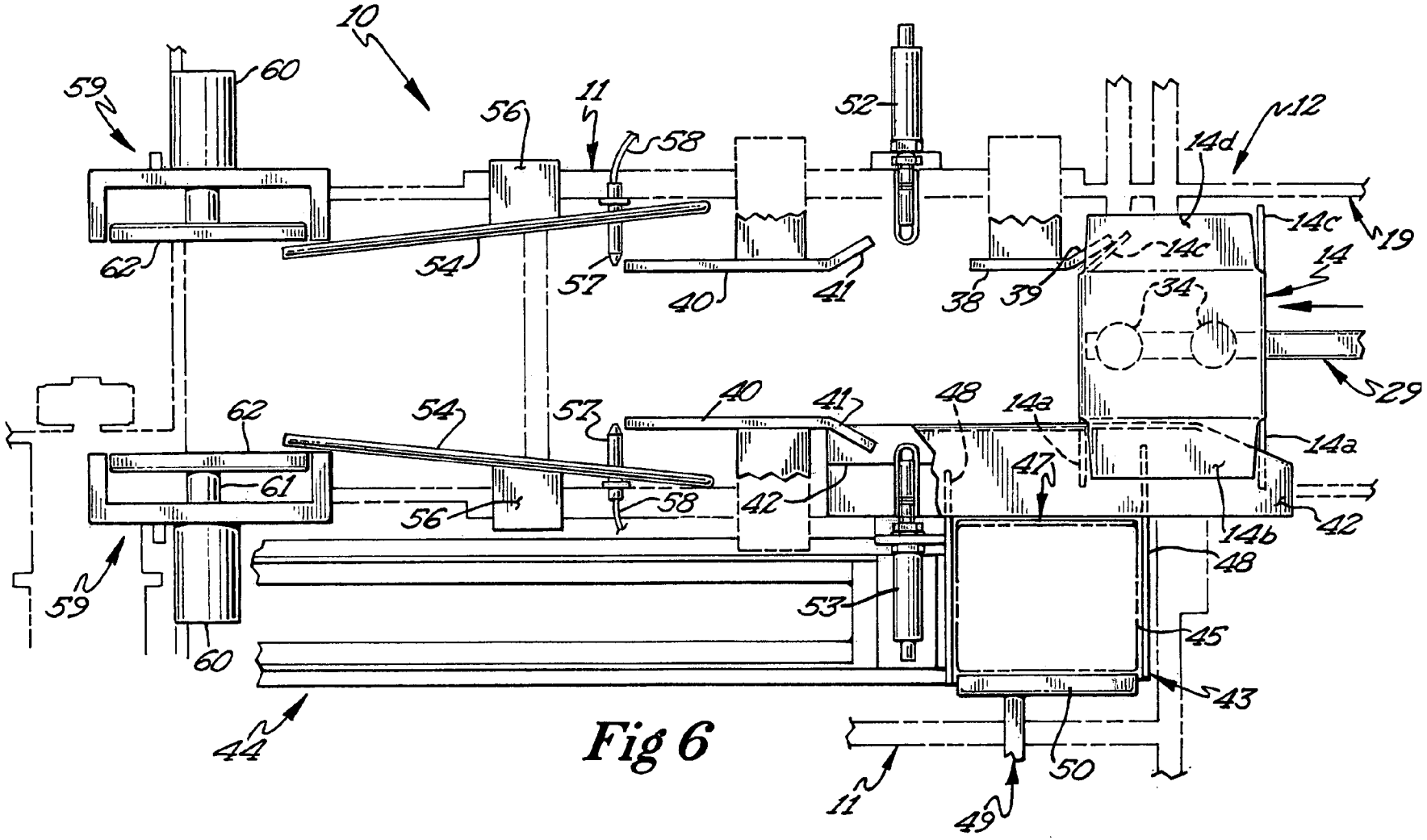
FIG. 6 is a diagrammatic top plan view illustrating the shuttle device moving a shipping container to the loading station.
Figures 6A, 6B:
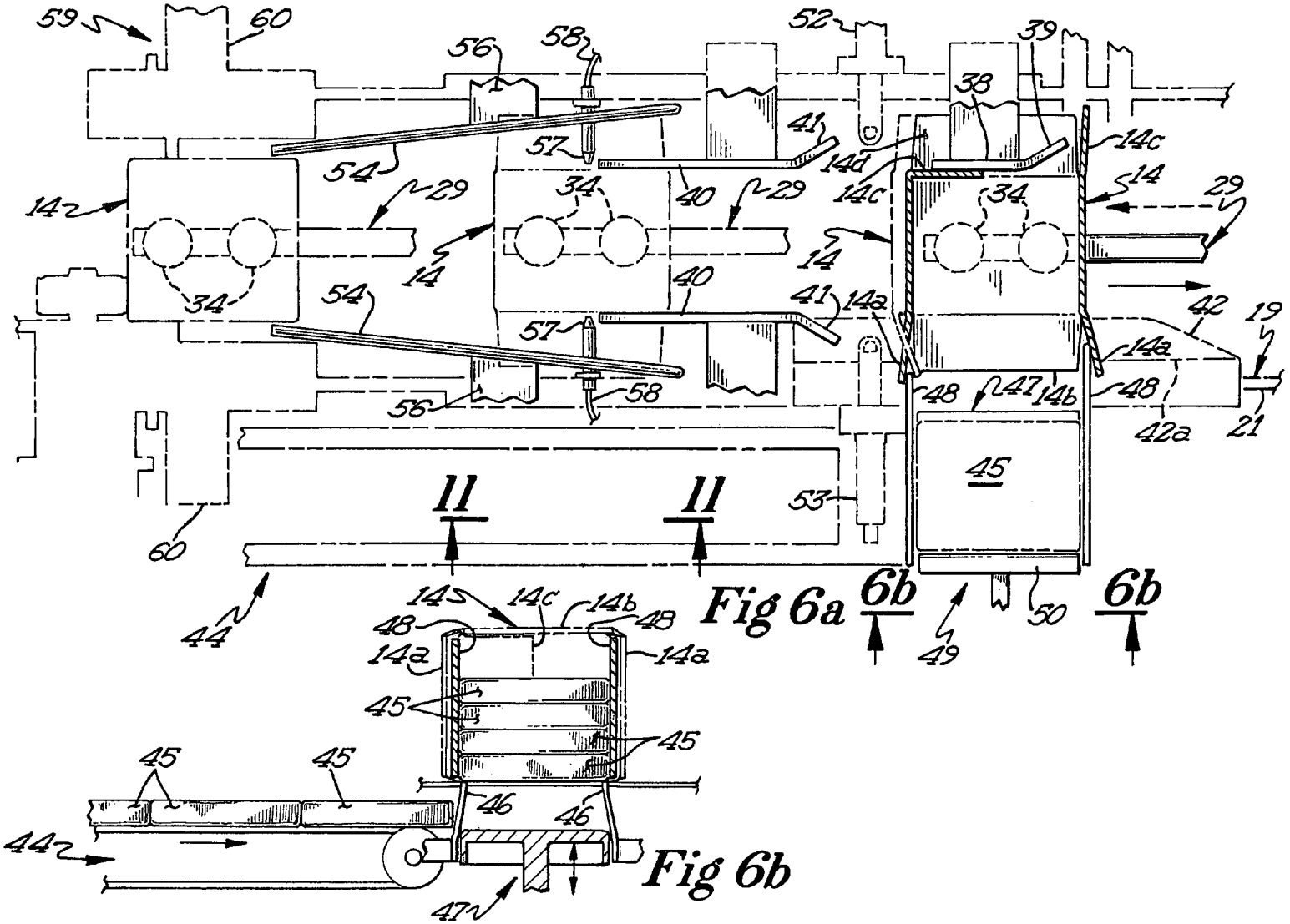
FIG. 6*a* is a diagrammatic top plan view similar to FIG. 6 and illustrating the shuttle device and shipping container mounted thereon at the loading station where product is loaded in the container.
FIG. 6*b* is a cross-sectional view taken approximately along line 6*b*—6*b* of FIG. 6*a* and looking in the direction of the arrows.

As the shuttle device 12 is moved in a downstream direction from the magazine 13, as best seen in FIG. 6, leading vertical minor flap 14*c* at the non-loading end of the shipping container is engaged by the outwardly flared portion 39 of a single plow 38. The leading vertical minor flap will be progressively folded to the closed position by the plow 38 as the shuttle device moves downstream. In FIG. 6, the shuttle device is approaching but is still upstream of the product loading station. In FIG. 6*a*, the shuttle device and shipping container are positioned at the loading station where product into the shipping container.

As the shuttle device moves downstream to the loading station as shown in FIG. 6*a*, the shuttle device 12 will move just slightly downstream of the loading station. The loading station is defined in part by a pair of laterally spaced apart, vertically disposed funnel plates 48. It will be seen that the upstream funnel plate 48 has a greater transverse dimension than the associated downstream funnel plate. Upper and lower horizontal plates 42 prevent the horizontal flaps being up or down.

As the shuttle device and shipping container are moved just downstream of the loading station (phantom line in FIG. 6*a*), the leading vertical minor flap 14*a* will engage and move past the downstream funnel plate 48. However, the trailing vertical minor flap 14*a* will engage but not move past the larger upstream funnel plate. The servomotor will then move the shuttle device slightly upstream to precisely align the shipping container 14 with the loading station 43. The leading and trailing vertical minor flaps 14*a* will be held in the open position by the funnel plates 48. The slight upstream movement of the shuttle device is the first "shuttle" of the shuttle device.

Referring again to FIGS. 6, 6*a*, and 6*b*, it will be seen that the product 45 is loaded into a shipping container 14 at the loading station 43. Product, in the form of cartons 45, is moved to the loading station by an infeed conveyor 44. Other types of containers and products may also be loaded into shipping containers. Product 45 is successively delivered to an elevator device 47 where the product is stacked for loading into a shipping container as best seen in FIG. 6*b*.

As the product is successively delivered to the elevator device 47, each product unit is moved by the elevator device past a pair of product retainer elements 46. The product retainer elements 46 are formed of spring metal or other resilient material and are shaped to permit passage of the product to the elevator device. In the embodiment shown, the product retainer elements are of U-shaped configuration and converge slightly in an upward direction. As each product unit is pushed upwardly, the retainer elements are pushed apart but spring back so that each successive product unit is supported on the upper edge of the retainer elements.

Product is stacked until the proper number of product units are stacked. It is pointed out that the product delivery and stacking is controlled by a servomotor whereby information is fed back to the computer by a conventional servomechanism in a well-known manner. The elevator device is also of well-known construction and operation.

Referring again to FIG. 6*a*, it will be seen that as the shipping container 14 reaches the loading station 43, the leading flap 14*c* will be bent to the closed position by the plow 38 while the trailing flap 14*c* will be in an essentially vertical unfolded position. The spacing between the funnel plates 48 corresponds to the internal width dimension of the shipping container 14.

A pusher mechanism 49 is mounted adjacent the loading station 43 and includes a pusher plate 50 which engages and pushes the product 45 into a shipping container 14 as the pusher mechanism is advanced. The pusher mechanism is retracted after the loading stroke. Advancement and retraction of the pusher mechanism 49 is controlled by a servomotor (not shown) that controls the magnitude and timing of the loading and retraction strokes. The flap 14*c* and the plow 38 prevent the product from being pushed through the container during the loading operation.

Figure 7:
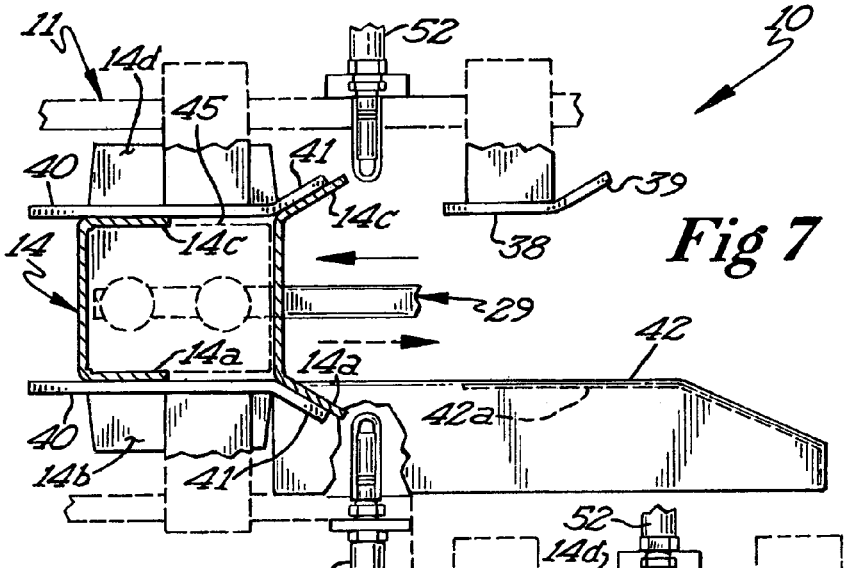
FIG. 7–9 are diagrammatic views illustrating the loading of a shipping container and the folding of minor end flaps thereof.

After product is loaded into the shipping container (FIG. 6*a*), the shuttle device is moved downstream where opposed plows 40 fold and hold the leading minor flaps 14*a* and 14*c* in the folded position as shown in FIG. 7. The plows 40 are disposed in substantially parallel relationship and each has an outwardly flared portion 41 which allows smooth transition of the folding. The trailing minor flaps 14*a* and 14*c* will be in the position illustrated in FIG. 7.

Movement of the shuttle device 12 will then be reversed and the shuttle device will move upstream. As the shuttle device and shipping container move upstream, the trailing minor flaps 14*a* and 14*c* will engage the arcuate end of a piston rod of pneumatic cylinders 52, 53. The pneumatic cylinders are disposed in opposed relation and are located just downstream of the loading station.

Figure 8:
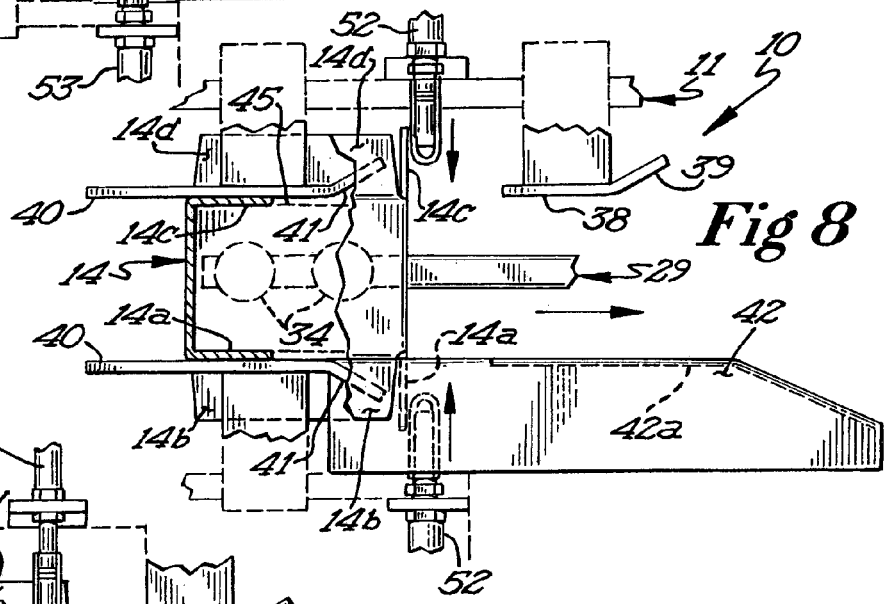
Figure 9:
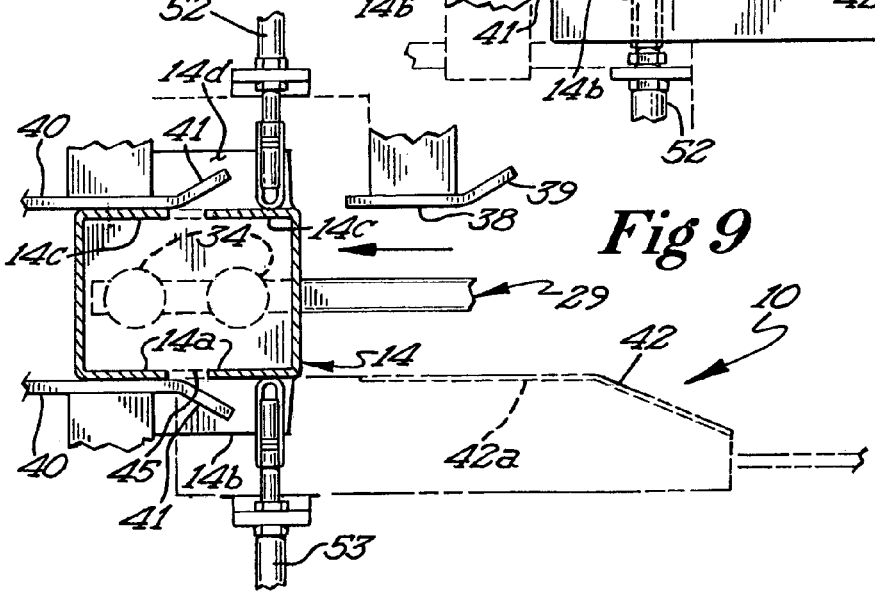
Figure 10:
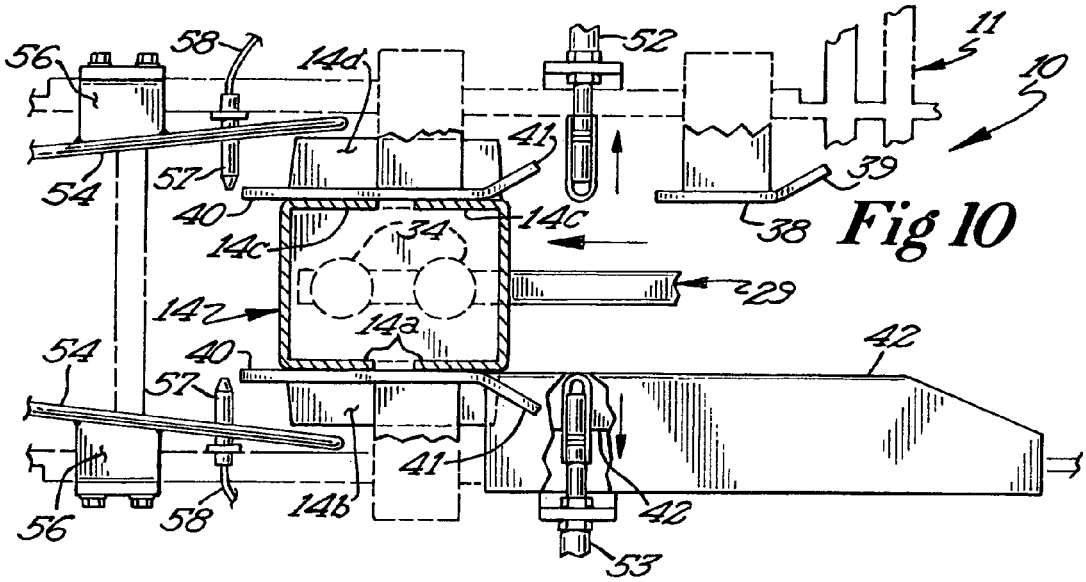
FIG. 10 is a diagrammatic top plan view illustrating folding of the minor flaps.
Figure 11:
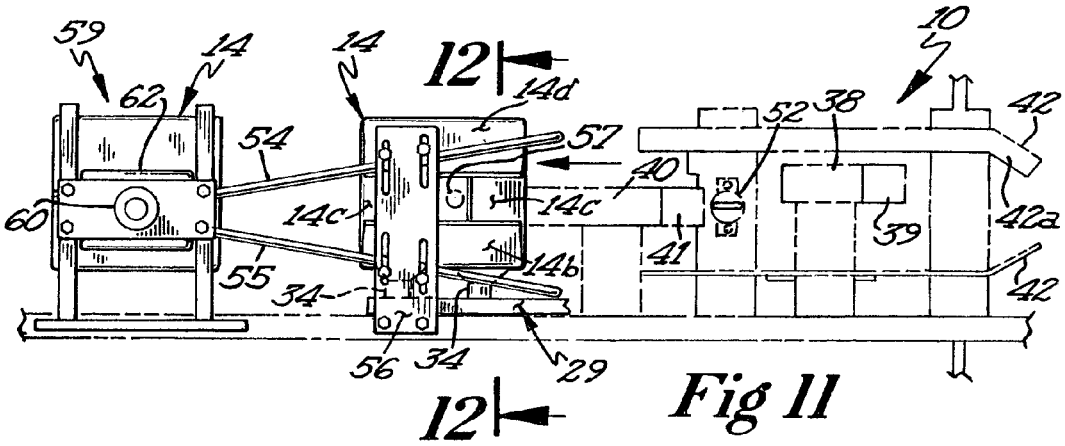
FIG. 11 is a diagrammatic side elevational view illustrating folding of the major flaps.

The pneumatic cylinders are in the retracted position when the trailing minor flaps 14*a* and 14*c* first engage the arcuate outer end as best seen in FIG. 8. Continued upstream movement of the shuttle device from the position shown in FIG. 8 causes the trailing minor flaps 14*a* and 14*b* to be folded slightly in a closing direction. The pneumatic cylinder are then fired and extend to hold the leading minor flaps in a folded position. This is the second shuttle movement (changes in direction). The leading minor flaps 14*a* and 14*c* are held in the folded condition by the pneumatic cylinder 52, 53 until all of the minor flaps are maintained in the folded position by the plows 40. This is clearly shown in FIG. 9. However, the upper horizontal plate 42 is provided with a depending vertical flange 42*a* which is engaged by the trailing minor flap 14*a* during the second shuttle movement shown in FIG. 7–9. The trailing minor flap 14*a* engages the flange 42*a* and is moved to the folded open position during downstream movement of the shuttle device (FIG. 7). When the shuttle device is moved in an upstream direction during the second shuttle movement, the minor trailing flap 14*a* engages the flange 42*a* and is moved to the folded position.

Continued movement of the shuttle device 12 in a downstream direction moves the major horizontal pair of flaps 14*c* and 14*d* into engaging relation with an upper pair of plows 54 and a lower pair of plows 55. It will be noted that one pair of upper and lower plows are located on each side of the shuttle device 12 as the shuttle is moved downstream. It will be noted that each pair of upper and lower plows 54, 55 on each side converge vertically toward each other in a downstream direction. Each pair of upper and lower plows on one side is mounted on a slotted plate 56 to permit adjustment of the plows. The pair of plows 54, 55 also converge laterally towards each other in a downstream direction as best seen in FIG. 1.

Referring now to FIG. 1, it will be seen that the plows 54, 55 overlap the plows 40 in a longitudinal direction. The plows 54 and 55 will be engaged by the upper and lower horizontal major flaps 14*c* and 14*d* as the shuttle device moves downstream. The upper and lower horizontal flaps 14*c* and 14*d* will be progressively folded to the closed position as the shuttle device continues to move in a downward direction. Since plows 54, 55 overlap the plows 40, the folded minor flaps 14*a*, 14*b* will be held by the initial folding of the horizontal major flaps and prevented from unfolding even though the container 14 has moved beyond the plows 40. The major flaps 14*c* and 14*d* will have folded to approximately thirty degrees from the horizontal when the minor flaps 14*a* and 14*c* are moved past the plows 40 as best seen in FIG. 12.

Figure 12:
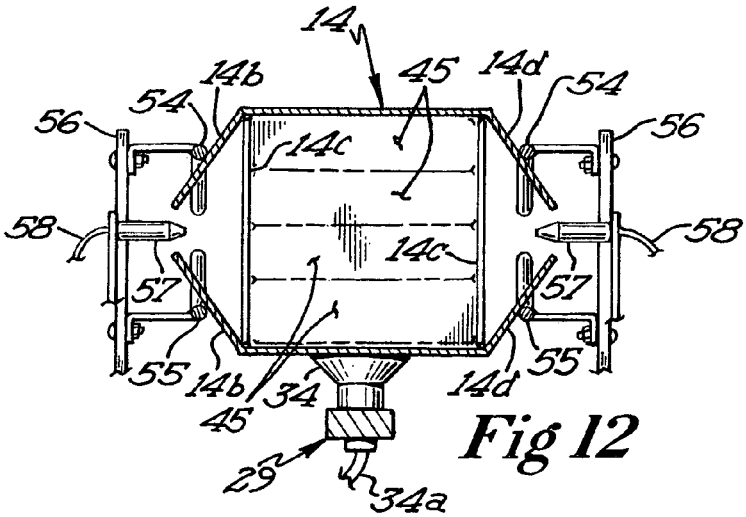
FIG. 12 is a cross-sectional view taken approximately along line 12—12 and looking in the direction of the arrows.

A pair of glue guns 57 are positioned in opposed relation to each other and on opposite sides of the loaded shipping container as best seen in FIGS. 6 and 12. The glue guns 57 are connected to a source of liquid glue by conduits 58 and spray glue on the minor flaps as the major horizontal are being folded. In the embodiment shown glue is applied to the minor flaps when the major flaps have been folded approximately thirty degrees.

After the application of the glue and folding of the major flaps, the container 14 is moved to a compression station 59 by the shuttle device where the glued major and minor flaps are compressed and held to permit setting of the glue. The compression station includes a pair of pneumatic cylinders 60 disposed in opposed relation and on opposite ends of a container as best in FIGS. 1 and 6. The piston rod 61 for each cylinder 60 has a compression plate 62 secured to the outer end thereof, Extension of the piston rod moves the compression plates into compressing relation with the ends of the container.

The loaded and sealed shipping containers are moved from the compression station to a conveyor (not shown) and are moved to another location.

It will be seen that the use of a servomotor driven shuttle device to support the shipping container throughout the packaging operation enables a substantial savings in parts and space. The "shuttle action" of the shuttle device allows for a more compact arrangement and the use of fewer parts.

What is claimed is:

1. A shuttle packaging machine for continuously forming, loading and sealing a paperboard shipping carton, comprising, an elongate support structure, a shuttle device, means mounting the shuttle device on the support structure for longitudinal movement thereof in a predetermined path of travel through continuous cycle of operation between an initial position and a completion position, where a shipping carton is loaded and sealed, and for return of the shuttle to the initial position, and during said travel, the shuttle device being shuttled during flap folding operations, power means operatively connected to the shuttle device for reciprocatively moving the shuttle device through its path of travel, a magazine for containing collapsed shipping cartons positioned adjacent the initial position of the shuttle device, each collapsed shipping carton comprising opposed side walls and having minor vertical flaps and major horizontal end flaps for closing the ends of the shipping carton, a moveable carton holding means on the shuttle device shiftable during movement of the shuttle device from a hold down position to a position for engaging and removing a collapsed shipping carton from the magazine and return to the hold down position holding the shipping carton on the shuttle device, former structure on the shuttle device engaged by a shipping carton during movement of the holding means to erect the shipping carton into box-like configuration having the end flaps of the container disposed in an unfolded position, the shipping carton being horizontally oriented with both ends of the carton open, one end of the carton comprising a loading end and the other end comprising a non-loading end, a loading station located downstream of the magazine, first minor flap folding means for engaging one vertical minor end flap at the non-closing end of the carton for folding the end flap to a closed position during shuttle movement of the shuttle device by the power means sequentially first in a downstream direction then in an upstream direction and thereafter in a downstream direction, means for engaging and moving product from the loading station into the shipping carton through the open loading end after said one minor end flap is folded to the closed position, second minor flap folding means located downstream of the loading station for progressively folding the unfolded minor end flaps to the folded closed position, during a second shuttle movement of the shuttle device by the power means sequentially first in a downstream direction then in an upstream direction and thereafter in a downstream direction, and major flap folding means for engaging and folding the major flaps to the folded position, and means for applying an adhesive to all the flaps to seal the ends thereof, discharging the loaded sealed carton from the shuttle device and returning the shuttle device to its initial position.

2. A shuttle packaging machine for continuously forming, loading and sealing shipping cartons with product, comprising, a support structure, a shuttle device for supporting a shipping carton thereon during product loading, closing and sealing of the carton, means mounting the shuttle device on the support structure for movement thereon, each shipping carton, when in an erect condition, including opposed side walls and having minor vertical flaps and major horizontal flaps for closing the ends of a shipping carton, power means operatively connected to the shuttle device for for reciprocatively the shuttle device generally in a downstream direction through product loading, closing and sealing cycles and for return of the shuttle to an original starting position, and during said travel, the shuttle device being shuttled during flap folding operations, means on the shuttle for engaging, removing and erecting collapsed shipping cartons from a magazine containing collapsed shipping cartons and for positioning and holding an erect carton in a horizontal position with both ends of the carton open, product being loaded through one open end of the carton, a loading station, means for engaging and moving product into the carton through said one open end of the carton, first flap folding means adjacent the loading station for folding and holding a minor vertical flap in a closed position at the non-loading end of a carton prior to loading product into the carton during shuttle movement of the shuttle device by the power means sequentially first in a downstream direction then in an upstream direction and thereafter in a final downstream direction, second flap folding means located downstream of the first flap folding means for folding and holding minor vertical flaps in a closed position during a second shuttle movement of the shuttle device by the power means sequentially in downstream direction, then in an upstream direction and thereafter in a downstream direction by said power means, major flap folding means engaging and folding the major flaps against the folded minor flaps during movement of the shuttle device in a downstream direction, means for applying an adhesive to the flaps to seal the flaps in a sealed condition, and removing the sealed carton from the shuttle device.

3. A shuttle packaging machine for continuously forming, loading and sealing shipping cartons with product, comprising a support structure, a shuttle device for supporting a shipping carton thereon during product loading, closing and sealing of the carton, shuttle mounting means on the support structure enabling movement of the shuttle device thereon, each carton including opposed side walls and having minor vertical flaps and major horizontal flaps for closing the open ends of the shipping carton, reversible power means operatively connected to the shuttle device for selectively moving the shuttle device generally in a downstream direction through product loading, carton closing and carton sealing cycles and for return of the shuttle device to an original starting position, and during the selective movement of the shuttle device, the shuttle device being shuttled by the power means during flap folding operations, a loading station, means for moving product into one open end of the carton, first flap folding means adjacent the loading station for folding and holding a minor vertical flap in a closed position at the non-loading end of carton prior to loading product into the carton during shuttle movement of the shuttle device by the power means sequentially first in a downstream direction then in an upstream direction and thereafter in a downstream direction, second flap folding means located downstream of the first folding means for folding and holding minor vertical flaps in a closed position during a second shuttle movement of the shuttle device by the power means first sequentially in a downstream direction, then in an upstream direction and thereafter in a downstream direction, major flap folding means engaging and folding the major flaps against the folded minor flaps during movement of the shuttle device in a downstream direction, means for applying adhesive to the flaps in a sealed condition and removing the sealed carton from the shuttle device.

4. The packaging machine as defined in claim 3 wherein said first folding means comprises a folding plow spaced from and substantially in opposed relation to the loading station.

5. The packaging machine as defined in claim 3 and means located downstream of the major flap folding means for compressing the folded flaps after the application of an adhesive, and thereafter discharging the carton from the shuttle device.

6. The packaging machine as defined in claim 5 and returning the shuttle device to the original starting position by the power means.

7. The packaging machine as defined in claim 3 wherein said second flap folding means comprises a pair of laterally spaced apart folding plows positioned downstream of the first folding means.

8. The packaging machine as defined in claim 7 and a pair of laterally spaced apart fluid operated piston and cylinder units disposed in opposed relation on opposite sides of the path of travel of the shuttle device, said cylinder and piston units being shiftable between and extended position and a retracted position, said piston and cylinder units being shifted to an extended position when the shuttle device is moved in a final downstream direction during the first shuttle movement to engage and hold the leading minor flaps in a folded position as the shuttle device continues its downstream movement.

9. The packaging machine as defined in claim 3 wherein said major flap closing means comprises opposed pairs of elongate plows located on opposed sides of the shuttle device, said plows being disposed in overlapping relation with respect to said second flap folding means.

10. The packaging machine as defined in claim 9 wherein said opposed pairs of plows converge toward each other in a downstream direction.

11. The packaging machine as defined in claim 9 wherein the plows of each pair are vertically spaced apart and converge vertically towards each other in a downstream direction.

12. The packaging machine as defined in claim 3 and a pair of vertically spaced apart horizontal plates mounted adjacent the loading station and engaged by and holding the horizontal flaps in a horizontal position, the uppermost horizontal plate having a vertical flange depending therefrom engaged by the trailing minor flap at the loading end of the carton during the final downstream movement of the second shuttle movement for folding the minor flap.

13. The shuttle packaging machine as defined in claim 3 wherein said shuttle mounting means comprises a pair of tracks on the support structure, and track engaging means on the shuttle device for engaging the tracks during movement of the shuttle device.

14. The shuttle packaging machine as defined in claim 3 where the power means comprises a servomotor.

* * * * *